US005553637A

United States Patent [19]

Hoeptner, III

[11] Patent Number: 5,553,637

[45] Date of Patent: Sep. 10, 1996

[54] FROST-FREE WATER SUPPLY

[76] Inventor: Herbert W. Hoeptner, III, 15085 Venetian Way, Morgan Hill, Calif. 95037

[21] Appl. No.: 414,228

[22] Filed: Mar. 31, 1995

[51] Int. Cl.[6] ..... E03B 9/04; E03B 9/14

[52] U.S. Cl. ..... 137/281; 137/301

[58] Field of Search ..... 137/281, 287, 137/288, 301, 302, 59, 62

[56] References Cited

U.S. PATENT DOCUMENTS

| | | | |
|---|---|---|---|
| 196,384 | 10/1877 | Porteous | 137/282 |
| 519,728 | 5/1894 | McGowan | 417/172 |
| 1,786,357 | 12/1930 | Miller | 137/892 |
| 1,937,667 | 12/1933 | Parsley et al. | 137/281 |
| 1,987,883 | 1/1935 | White et al. | 137/252 |
| 2,482,283 | 9/1949 | McGarry | 137/281 |
| 2,580,199 | 12/1951 | Schmid | 137/301 |
| 2,598,488 | 5/1952 | Bart | 137/282 |
| 2,598,968 | 6/1952 | Boosey | 137/301 |
| 2,605,781 | 8/1952 | Schmid et al. | 137/282 |
| 2,664,096 | 12/1953 | Murdock et al. | 137/301 |
| 3,017,896 | 1/1962 | Papacek | 137/282 |
| 3,770,003 | 11/1973 | Uroshevich | 137/281 |
| 3,885,585 | 5/1975 | Carpentier | 137/282 |
| 4,096,877 | 6/1978 | Arledge, II | 137/281 |
| 4,109,671 | 8/1978 | Hughes et al. | 137/282 |
| 4,282,895 | 8/1981 | Young | 137/281 |
| 4,520,836 | 6/1985 | Hutter, III | 137/301 |
| 4,653,521 | 3/1987 | Fillman | 137/281 |
| 4,653,522 | 3/1987 | Fillman et al. | 137/281 |
| 4,854,339 | 8/1989 | Hoeptner, III | 137/282 |
| 5,033,500 | 7/1991 | Hoeptner, III | 137/282 |
| 5,261,441 | 11/1993 | Anderson | 137/281 |

*Primary Examiner*—George L. Walton
*Attorney, Agent, or Firm*—William W. Haefliger

[57] ABSTRACT

A freeze-resistant water supply system comprising a drinking water outlet having an ON-OFF control; a water supply line to the outlet and having a section subjected to cold temperature, and a drain line associated with the outlet to receive discharge water supplied via the outlet; and, apparatus operatively coupled with the water supply line and drain line for periodically effecting evacuation of water from the supply line section for ultimate flow to the drain line, as a function of the operation of the ON-OFF control.

3 Claims, 3 Drawing Sheets

12
11
12a
16a
20
15a
15
14
13a
52
55
54
36
53
34
73
17
20a
82
81
47
31
41
22
45
51
50
71
~21~
(ON)
49
48
46
32
40
30
44
33
24
13b
70
13

FROST-FREE WATER SUPPLY

BACKGROUND OF THE INVENTION

This invention relates generally to frost-free water supply, as at drinking fountains during cold weather conditions; and more specifically, it concerns simple, effective and reliable apparatus that assures freeze resistance of water supplied to drinking water outlets.

The problem of freezing of drinking water lines proximate aboveground fountains has been continual, especially in colder climates. There is great need for improved apparatus that will enable reliable prevention of freezing of water supplied to such drinking fountains.

SUMMARY OF THE INVENTION

It is a major object of the invention to provide simple, effective and reliable apparatus that will overcome the above problem and meet the need for freeze prevention.

Basically, a freeze-prevention water supply system, in accordance with the invention, comprises:

a) a drinking water outlet having an ON-OFF control, b) a water supply line to the outlet and having a section subjected to cold temperature, and a drain line associated with the outlet to receive discharge water supplied via the outlet, and c) apparatus operatively coupled with the water supply line and drain line for periodically effecting evacuation of water from the supply line section for ultimate flow to the drain line, as a function of the operation of the ON-OFF control.

It is another object to provide apparatus, as referred to, which includes a water storage chamber connected between the freezable section and the drain line; and an ON-OFF valve connected in series with the water supply line, the ON-OFF control including a manually controlled part near the outlet and connected in controlling relation with the ON-OFF valve.

As will appear, the apparatus advantageously includes a master and slave piston and cylinder unit, driven in response to changes in pressure of water in the supply line, and operatively associated with the supply line section to periodically receive water evacuated therefrom and to discharge the evacuated water to the drain line.

Yet another object includes the provision of a freeze-resistant water supply system that includes:

a) a drinking water outlet having an ON-OFF control, b) first and second chambers, the first chamber having an inlet or port connected to a pressurized water supply connectible to the outlet, the second chamber having a primary inlet connected to the outlet, via a water supply line section subjected to cold temperature, and a secondary inlet or port connected to a drain associated with the outlet, as via an auxiliary line subjected to cold temperature, c) interconnected first and second pistons, respectively, in the first and second chambers, and spring means urging the pistons in one direction, d) and a control valve connected between the first chamber inlet and the drinking water outlet, the valve having ON and OFF positions, e) whereby in OFF position of the control valve, the pressurized water supply exerts pressure on water in the first chamber to displace the pistons in one direction allowing filling of supply water into the first chamber and draining of water from the supply line section into the second chamber, as well as any draining of water from the auxiliary line into the second chamber, and in ON position of the control valve the spring means displaces the piston in the opposite direction, whereby water in the first chamber is displaced to the drinking water outlet and water in the second chamber is displaced to the drain.

As will appear, the ON-OFF control valve is typically located underground to prevent freezing thereof; and the ON-OFF control is located proximate the fountain outlet and is operatively connected with the below ground valve.

Yet another object is to provide a spring biased (or other mode of biasing) check valve associated with the second chamber primary inlet to pass drainage of water from the freezable section to the second chamber in OFF position of the ON-OFF valve. That check valve includes elements sized and located to block egress of pressurized supply water to the drinking water outlet in OFF position of the ON-OFF valve.

These and other objects and advantages of the invention, as well as the details of an illustrative embodiment, will be more fully understood from the following specification and drawings, in which:

DRAWING DESCRIPTION

DETAILED DESCRIPTION

Figure 1:
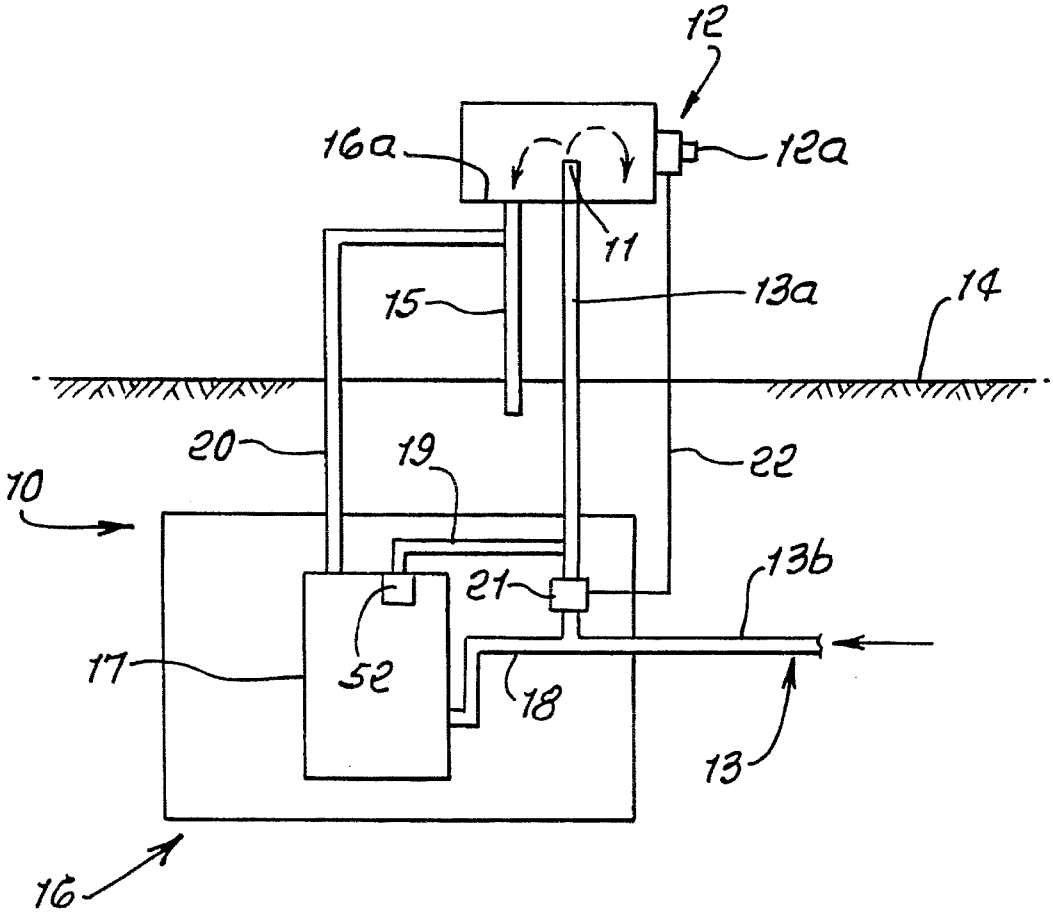
FIG. 1 is a block diagram of a freeze-resistant water supply system.

Referring first to FIG. 1, a basic freeze-resistant water supply system is shown at 10. The system includes a drinking or potable water outlet 11 having an ON-OFF control indicated at 12. The latter may, for example, include a push button **12*a*, which is OFF when released and ON when pushed, to allow supply water to flow under pressure to outlet 11. A water supply line 13 is connected to the outlet 11, and typically has a freezable section 13*a* subjected to cold temperature. Section 13*a* is shown, for example, as extending aboveground level 14**, and may be subjected to freezing temperatures.

One purpose of the invention is to evacuate water from line section **13*a* when the control 12 is OFF, to prevent freezing of water in the section 13*a*. Supply line section 13*b* leading to 13*a*** is typically not subjected to freezing temperatures, and may be underground, as shown.

A drain line 15 is associated with the outlet 11 to receive discharge, i.e., unused water, supplied via the outlet. A water basin or bowl **16*a*** may collect such discharge water and conduct it to the drain.

In accordance with the invention, apparatus is provided as generally indicated at block 16 to be operatively connected with the water supply line and drain line for periodically effecting evacuation of water from the supply line section for ultimate flow to the drain line, as a function of the operation of the ON-OFF control. Typically, when the PUSH button is pushed to ON condition, water flows via line 13 and section **13*a* to the outlet 11, which may be a water fountain; and when the PUSH button is released, water is evacuated from the line section 13*a*** for ultimate flow to the drain line.

Accordingly, the flows in the section 13*a* to 11, and in evacuation mode, are a periodic function of operation of the ON-OFF control.

Further, FIG. 1 shows that apparatus 16 may include a master and slave piston and cylinder unit 17, the pistons driven back and forth, in response to changes in pressure of water in the supply line. For example, in OFF condition, water pressure in the supply line is at a pressure $p_1$, which is higher level than the pressure $P_2$ therein when water is flowing to the outlet 11, in ON condition.

Note line 18 connecting unit 17 and supply line 13*b*; line 19 also connecting 17 and supply line section 13*a*; and line 20 connecting 17 and drain line 15. Also, apparatus 16 may be considered to include an ON-OFF valve 21 connected in series with the water supply line, the ON-OFF control including a manually controlled part near said outlet 11 and connected in controlling relation with the ON-OFF valve. Note that valve 21 is shown in FIG. 1 as connected in series between 13*b* and 13*a*, and that there is a control line 22 connected between valve 21 and the control 12, whereby, when button 12*a* is pushed ON, the valve 21 is ON (open), and when button 12*a* is released, valve 21 is OFF (closed).

Figure 2:
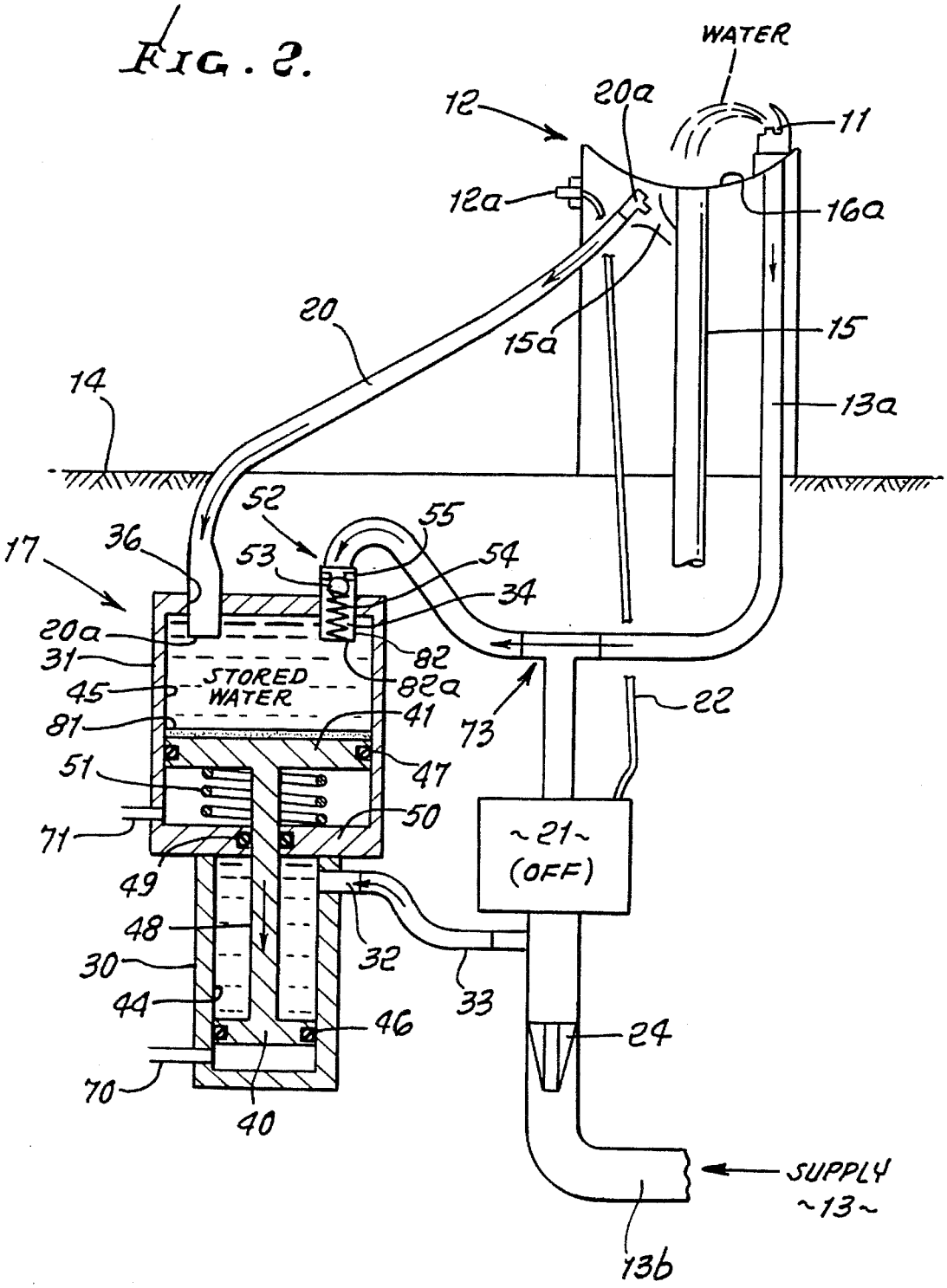
FIG. 2 is a more detailed diagrammatic view of a freeze-resistant water supply system in OFF position.
Figure 3:
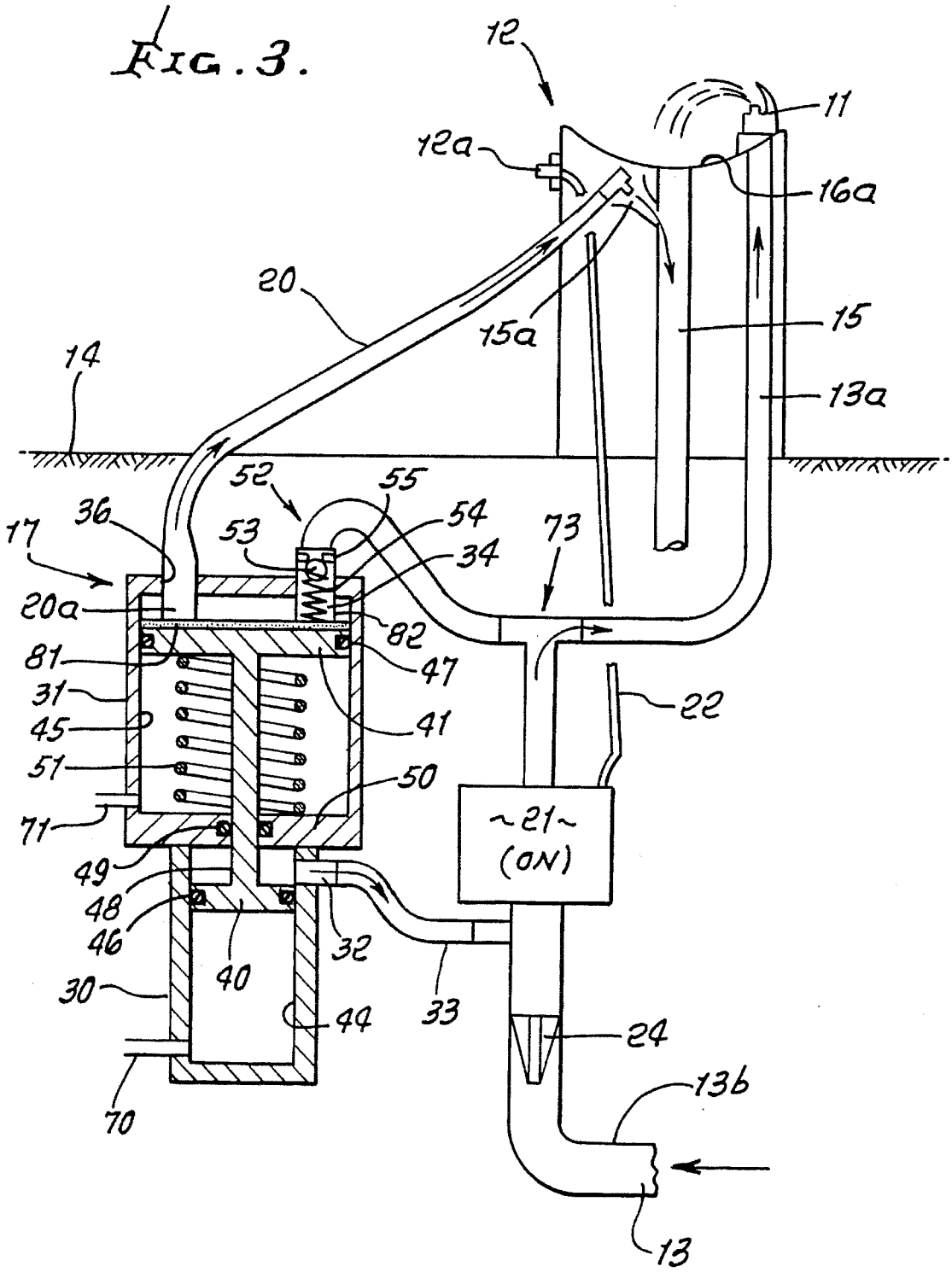
FIG. 3 is a view like FIG. 2 showing the system in ON position.

The system shown in FIGS. 2 and 3 has elements certain of which are the same or equivalent to those shown in FIG. 1, and bear the same identifying numbers. Valve 21 may be operated by changes in pressure communicated from control 12 to the valve, as when PUSH button 12*a* is pushed and subsequently released. Such valves are known, examples being Model AIRTROL supplied by Acorn Company.

In FIGS. 2 and 3, the line 20 has its outlet end 20*a* open to atmosphere, to discharge stored water from unit 17 openly into drain line 15 via mouth 15*a* of the latter.

In addition, a flow regulator 24 may be installed in supply line 13*b* to regulate the flow to the outlet 11, as for example to flow rate between 0.4 and 0.6 gallons per minute, when valve 21 is open.

unit 17 may advantageously take the form, as shown in detail in FIGS. 2 and 3. It includes first and second chambers 30 and 31, typically located underground, for above freezing temperature operation. Chamber 30 has inlet or port 32 connected at 33 to pressurized water supply line 13*b*, the latter being connectible to outlet 11, as referred to above. The second chamber 31 has a primary inlet 34 connected at 35 to the outlet 11 via the supply line section 13*a* subjected to freezing temperature, i.e., aboveground; and it has a secondary inlet 36 connected at 20 to the drain 15, as referred to above.

Unit 17 also includes first and second pistons 40 and 41, respectively, in chambers 30 and 31, the pistons slidable in relatively smaller and larger bores 44 and 45 in the chambers. Note also O-ring seals 46 and 47 carried by the pistons to seal against such bores. Rod 48 interconnects the pistons, and an 0-ring seal carried by chamber bottom wall 50, engages and seals off against that rod. A compression spring 51 between wall 50 and piston 41 urges the latter upwardly, as during ON condition of valve 21, and is compressed when supply water pressure communicated to piston 40 in chamber 30 urges piston 40 downwardly, in OFF condition of the valve 21. Atmospheric vents appear at 70 and 71.

In OFF position of the control valve, the pressurized water supply exerts pressure on water in the first chamber 30 to displace the pistons in one direction (down) allowing filling of supply water into the first chamber and draining of water from the supply line section 13*a* into the second chamber 31, and also draining of water in aboveground auxiliary line 20 into chamber 31; and in ON position of the control valve, the spring means 51 displaces the pistons in the opposite direction, whereby water in the first chamber is displaced to the outlet, and water in the second chamber is displaced to the drain 15.

Accordingly, chamber 31 serves as a temporary storage chamber for water evacuated by gravity drainage from line section 13*a*, and line 20, when valve 21 is OFF, such stored water in 31 subsequently being discharged to drain 15, as pistons 40 and 41 rise during ON condition of the valve 21.

FIGS. 2 and 3 also show provision of a spring-biased check valve at 52 associated with the second chamber primary inlet to pass drainage of water from the section 13*a* to the second chamber in OFF position of the ON-OFF valve. See ball 53, urged by spring 54, toward annular seat 55, the ball being downwardly displaced from the seat to allow inflow of water evacuating from line section 13*a*, when valve 21 is OFF. Ducting 35 extends from 52 to 13*a*, as shown, as via tee 73.

Accordingly, the check valve has elements located and sized to perform three important functions, as follows:

i) the check valve allows inflow of water being evacuated from "cold" line section 13*a* to "warm" chamber 31, during OFF condition of the valve 21;

ii) the check valve blocks outflow of water from within chamber 31 to the line section 13*a*, and to fountain outlet 11, during ON condition of the valve 21; and iii) the check valve blocks inflow of water from the supply line 13*a* during ON condition of the valve 21, since water pressure in the chamber 31, and pressure of the spring at the check valve, keeps the check valve closed.

A feature of the invention is the fact that water collecting in slave chamber 31 is not reintroduced into the potable water line section 13*a*. In FIG. 3, note that a rubber sheet or gasket 81, extending on and over the top of piston 41, sealingly engages the open lower end 20*a* of line 20, and the open lower end 82*a* of check valve duct 82.

I claim:

1. In a freeze-resistant water supply system, the combination comprising:

a) a drinking water outlet having an ON-OFF control, b) a water supply line to said outlet and having a section subjected to cold temperature, and a drain line associated with said outlet to receive discharge water supplied via said outlet, and c) apparatus operatively coupled with said water supply line and drain line for periodically effecting evacuation of water from said supply line section for ultimate flow to said drain line, as a function of the operation of said ON-OFF control, d) said apparatus including a master and slave piston and cylinder unit, driven in response to changes in pressure of water in said supply line, and operatively associated with said supply line section to periodically receive water evacuated therefrom and to discharge said evacuated water to said drain line, e) said unit including a water storage chamber, sand there being two additional lines, each communicating with said water storage chamber, one of said additional lines communicating with said drain line, and the other of said additional lines, communicating with said water supply line, f) whereby in said control OFF condition, supply water pressure drives said unit in one direction to cause water in said other additional line to flow to said water storage chamber, g) and in said control ON condition, supply water flows from said supply line to said drinking water outlet and said unit is driven tin the opposite direction to cause water in said water storage chamber to flow via the said one additional line to said drain line.

2. The combination of claim 1 wherein said apparatus includes an ON-OFF valve connected in series with said water supply line, said ON-OFF control including a manually controlled part near said outlet and connected in controlling relation with said ON-OFF valve.

3. The combination of claim 1 wherein said outlet is aboveground and said unit is underground.

* * * * *